US006044908A

United States Patent [19]

Wyatt

[11] Patent Number: 6,044,908

[45] Date of Patent: Apr. 4, 2000

[54] SLIDING SLEEVE VALVE AND SEAL RING FOR USE THEREIN

[75] Inventor: Mark L. Wyatt, The Woodlands, Tex.

[73] Assignee: Grant Prideco, Inc., Houston, Tex.

[21] Appl. No.: 09/087,759

[22] Filed: May 29, 1998

[51] Int. Cl.[7] ..... E21B 34/14

[52] U.S. Cl. ..... 166/332.4; 277/648; 277/337

[58] Field of Search ..... 166/332.1, 332.4; 277/648, 337, 336, 626, 644

[56] References Cited

U.S. PATENT DOCUMENTS

| | | |
|---|---|---|
| 4,273,186 | 6/1981 | Pearce et al. . |
| 4,432,416 | 2/1984 | Welch et al. . |
| 4,441,558 | 4/1984 | Welch et al. . |
| 4,524,831 | 6/1985 | Pringle . |
| 4,603,741 | 8/1986 | Edgmon . |
| 4,793,621 | 12/1988 | Heinze . |
| 4,802,359 | 2/1989 | Patrice . |
| 4,848,457 | 7/1989 | Lilley . |
| 4,915,175 | 4/1990 | Mashaw, Jr. . |
| 4,917,191 | 4/1990 | Hopmann et al. . |
| 4,944,349 | 7/1990 | Von Gonten, Jr. . |
| 4,949,788 | 8/1990 | Szarka et al. . |
| 4,969,524 | 11/1990 | Whiteley . |
| 5,090,481 | 2/1992 | Pleasants et al. . |
| 5,156,220 | 10/1992 | Forehand et al. . |
| 5,263,683 | 11/1993 | Wong . |
| 5,285,850 | 2/1994 | Bayh, III . |
| 5,474,131 | 12/1995 | Jordan, Jr. et al. . |
| 5,598,890 | 2/1997 | Richard et al. . |

*Primary Examiner*—William Neuder
*Assistant Examiner*—Zakiya Walker
*Attorney, Agent, or Firm*—Browning Bushman

[57] ABSTRACT

A sliding sleeve valve for controlling fluid flow between a well annulus and a string of well conduit, the valve including a slidable sleeve disposed coaxially within an outer housing, the valve being provided with a primary seal member carried by the housing for sealing engagement with the housing and the sleeve characterized in that the primary seal member, in a relaxed condition, comprises an annular, monolithic body having a first, radially outwardly facing, annularly extending seal surface and a second, radially inwardly facing, annularly extending seal surface, the second seal surface having at least one annularly extending, radially inwardly projecting rib, the rib having a radially innermost convex portion when viewed in transverse cross-section, annularly extending reliefs being formed on axially opposite sides of the rib, the seal member being made of a substantially non-elastomeric material that has sufficient memory to provide an interference seal between the seal member and the housing, and the seal member and the sleeve.

12 Claims, 7 Drawing Sheets

SLIDING SLEEVE VALVE AND SEAL RING FOR USE THEREIN

BACKGROUND OF THE INVENTION

1. Field of the Invention

The present invention relates to downhole sliding sleeve valves. More particularly, the present invention relates to such a sliding sleeve valve having a wear-resistant seal ring.

2. Description of the Prior Art

Sliding sleeve valves are used in numerous downhole applications in the oil and gas industry. Examples of such valves are sliding sleeve valves sold under the trademark "SLIDING SIDE DOOR" type XA by Otis Engineering Corp. In particular, U.S. Pat. No. 5,263,683 ('683 Patent), incorporated herein by reference for all purposes, discloses a sliding sleeve valve or sliding sleeve of the type under consideration. As disclosed in the '683 Patent, the sleeve valves have a tubular housing or main body that can comprise one or more assembled portions and that can be made up into a string of well conduit (typically production tubing, but conceivably drill pipe or some other conduit type) as part thereof. The valve can be used to selectively prevent or permit flow between the well annulus and the interior of the string of conduit, e.g., a tubing string. For example, packers in the string above and/or below the valve can be used to pack off or isolate a given zone of the wellbore. The sleeve can be left closed to maintain that isolation or, when it is desired to produce from that zone, the sleeve can be opened to permit fluid to flow from the zone into the tubing string. In other cases, the valve may be opened to permit a fluid to pass from the interior of the tubing string into the annulus.

In a sleeve valve such as disclosed in the '683 Patent, one or more flow ports extend radially through the housing wall. A valve element in the form of a tubular sleeve carried coaxially within the housing is provided with and is movable longitudinally relative to the housing, from a first, or closed, position in which the sleeve blocks off flow through the flow ports, prohibiting flow between the annulus and the interior of the valve and a second, or open, position wherein the flow apertures in the sleeve are in register with the flow ports in the housing so that fluid can flow from the annulus into the tubing string or vice versa. In such sleeve valves, there are a series of upper and lower auxiliary seal stacks to effect dynamic sealing between the housing and the sleeve, which passes across the seals during opening and closing of the flow port through the housing.

It frequently happens that there is considerable pressure in the annulus surrounding the housing, thereby creating a large pressure differential between the annulus and the interior of the valve. Accordingly, during movement of the sleeve to open the flow ports to permit fluid communication between the interior and exterior of the valve, the auxiliary seals positioned between the housing and the sleeve will first be exposed to a surge of fluid flow, which can cause extensive damage to the seals as pressure is equalized before a full positive opening of the sleeves and, in some instances, during complete opening of the sleeve. In any event, any time such auxiliary seals are exposed to flow surging, since they are dynamic in nature, a leak path could be formed through the auxiliary seals. One way to at least partially prevent damage to the auxiliary seal stacks is to dissipate or equalize this large differential pressure, as by allowing slow bleeding of the high pressure fluid from the annulus into the valve before full production flow is established.

One way to accomplish this pressure equalization, and as disclosed in the '683 Patent, is to provide the sleeve element with a small pressure relief orifice, which, when the valve is in the closed position, is disposed between a primary seal, which seals between the housing and the sleeve, and the flow apertures in the sleeve and is designed to protect the auxiliary seal stack, the primary seal being positioned between the auxiliary seal stack and the flow port. Accordingly, the sleeve element can be moved longitudinally within the housing in a first direction until the pressure relief orifices are in open communication with the flow ports in the housing to allow fluid to bleed from the annulus slowly through the pressure relief orifices until the pressure in the tubing string is approximately equal to that in the annulus. Following the pressure equalization, the sleeve element can be moved still further in the first direction to an open position, wherein the flow ports in the housing and the flow apertures in the sleeve are in register, providing substantially greater flow area than the pressure relief orifices. Obviously, it would be desirable if the pressure equalization step could be eliminated such that the valve could be moved from the closed position directly to the full open position.

When the sleeve element is moved from the closed position to the equalizing position, the pressure relief orifices slide across the primary seal. The large pressure differential between the annulus and the interior of the valve acts on the primary seal, urging it radially inwardly against the sleeve element. Thus, when the edges of the pressure relief orifice slide past the primary seal, there is a tendency to clip off a bit of the material from which the primary seal is made, eventually ruining its sealing effectiveness.

In the '683 Patent, it was found that this clipping of the primary seal could be largely eliminated by forming recesses in the outer surface of the sleeve in surrounding relationship to the orifice, the recesses having a dimension that is longer, in the axial direction, than the radially outer end of the pressure relief orifice. The recess is sized, configured, and positioned to permit the pressure relief orifice to pass the primary seal while moving from the closed position to the pressure relief position without substantial damage to the primary seal, even when the latter is made of an elastomeric material, e.g. an O-ring.

Even though the sleeve valve of the '683 Patent overcomes the seal clipping problems to a substantial extent, it has been found that under severe operating conditions, e.g., elevated temperatures, and/or conditions where the primary seal is subject to chemical attack, the primary seal still undergoes an undesirable failure rate. Thus, it would be desirable if the sleeve valve possessed a primary seal assembly or member that would form an effective seal between the housing and the sleeve and would permit the valve to go from closed to full open without equalization while still protecting the auxiliary seal stack.

SUMMARY OF THE INVENTION

It is therefore an object of the present invention to provide a sliding sleeve valve utilizing a primary seal member formed of elevated heat and pressure-resistant material.

Another object of the present invention is to provide a sliding sleeve valve having a primary seal member that has sufficient elasticity or memory to provide a fluid-tight seal between first and second coaxially disposed tubular members, one of said members being longitudinally movable relative to the other member.

Still another object of the present invention is to provide a sliding sleeve valve employing a primary seal member that exhibits resistance to chemical attack.

The above and other objects of the present invention will become apparent from the drawings, the description given herein, and the appended claims.

The sliding sleeve valve of the present invention can be similar to the sliding sleeve valve disclosed in the '683 Patent and includes a generally tubular housing adapted to be connected in the string of well conduit, e.g., a tubing string, to form a part of the string, the housing including at least one radial flow port therethrough. Coaxially and slidably disposed interiorly of the housing is a sleeve element having at least one flow aperture that, when in register with the flow port in the housing, permits fluid flow between the interior of the valve/tubing string and the exterior of the housing, e.g., in the annulus between the housing and an earth borehole or casing. Disposed between the housing and the sleeve element is an annular, primary seal member that provides fluid-tight sealing engagement between the housing and the sleeve. In a first, or closed, position of the valve, the primary seal member is disposed between the flow port(s) and the housing and the flow aperture(s) in the sleeve. Optionally, radial pressure relief or bleed orifices are formed in the sleeve in an exterior seal portion thereof that is engaged by the primary seal member, the bleed orifices, if used, being disposed between the primary seal and the flow apertures in the sleeve when the sleeve valve is in the closed position. In a second, or pressure-equalizing, position, the bleed orifices are in register with the flow ports in the housing such that both the flow ports in the housing and the bleed orifices are on the same axial side of the primary seal member. The novel sleeve valve of the present invention is characterized by an annular, primary seal member that is monolithic and that in the relaxed condition, i.e., not sealingly engaged with the housing and the sleeve, has a first, annularly extending, radially outwardly facing seal surface and a second, annularly extending, radially inwardly facing seal surface, the radially inwardly facing seal surface comprising an annular rib, said rib having a convex portion when viewed in transverse cross-section. The second seal face has a first annularly extending relief on one axial side of the rib and a second, annularly extending relief on the other axial side of the rib. The seal member is made of a substantially non-elastic material possessing sufficient memory so as to provide an interference, fluid-tight seal between the housing and the sleeve.

DESCRIPTION OF THE PREFERRED EMBODIMENTS

Figure 1A:
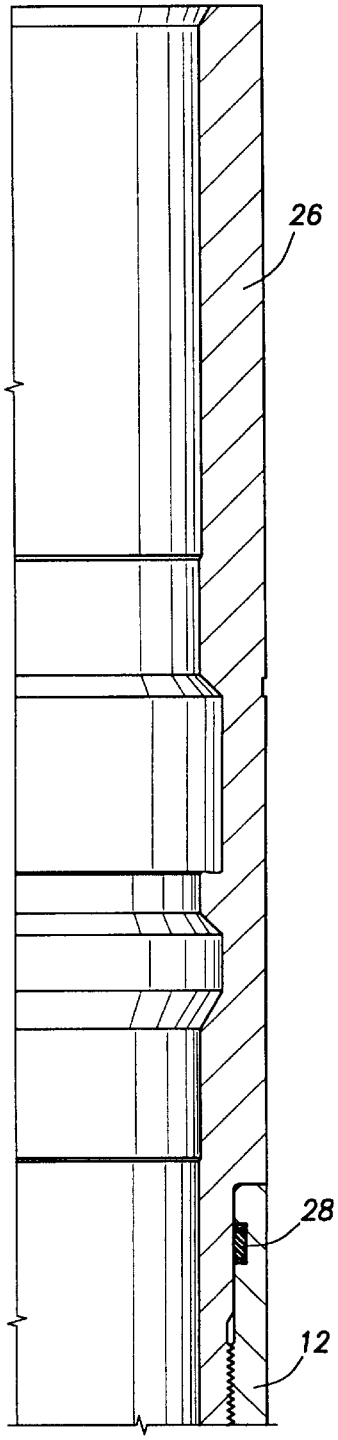
FIGS. 1*a*–1*f* are longitudinal, quarter-sectional views of a sliding sleeve valve according to the present invention in the closed position.
Figure 1B:
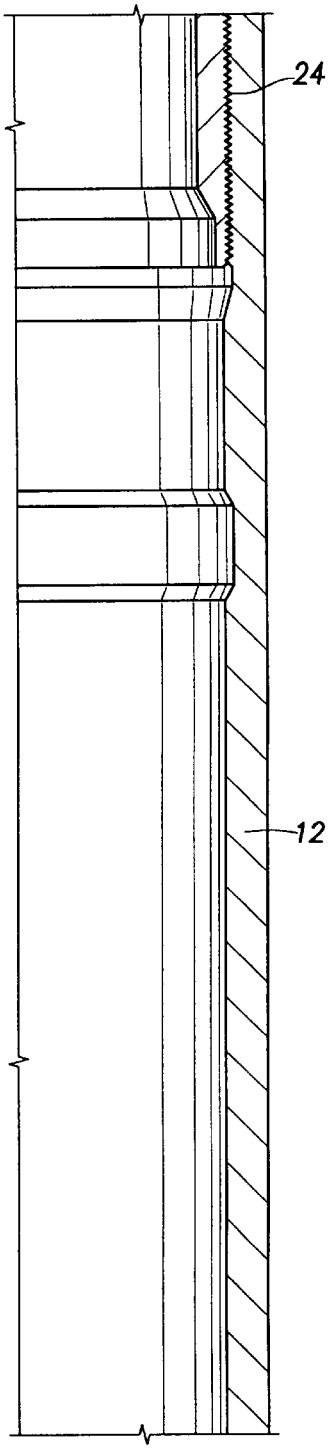

In the description that follows, and unless otherwise noted, the terms "longitudinal" and "transverse" will be used with reference to the sleeve valve as a whole; "length" of the valve or a part thereof will be with reference to the longitudinal direction of the valve as a whole; "thickness" will be with reference to a radial direction with respect to the valve as a whole; and "width" will be with reference to a transverse or circumferential direction with respect to the valve as a whole.

With reference to FIGS. 1*a*–1*f*, the valve is seen to include a tubular housing or main body that can be formed of three adjoined portions or members, central tubular portion 10, upper tubular portion 12, and lower tubular portion 14, portions 10 and 12 being threadedly connected as at 16, a seal ring 18 serving to provide fluid-tight sealing between portions 10 and 12. Central portion 10 is threadedly connected to lower portion 14, fluid-tight sealing between central portion 10 and lower sub 14 being effected by seal ring 22. Upper tubular member 12 is threadedly connected, as at 24, to a sub 26, which can be adapted, e.g., threaded, to be connected into the tubing string, fluid-tight sealing between upper tubular member 12 and sub 26 being effected by a seal ring 28. Likewise, lower tubular member 14 is threadedly connected, as at 30, to a lower sub 32, which can be adapted in a manner well known to those skilled in the art to be adjoined to the tubing string, fluid-tight sealing between lower sub 32 and lower tubular member 14 being effected by seal ring 34. Central tubular member 10 is provided with a plurality of radial flow ports 36, which, when valve is in the open position, allows fluid communication between the annulus, exterior of tubular member 10, and the interior of the valve, and then the interior of the tubing string of which the valve forms a part.

Central tubular member 10 has a counterbore 38 at its upper end that cooperates with a reduced diameter portion 40 of upper tubular member 12 to effectively form an annular seal recess in which is received a stack of seal rings 42, including a plurality of upper chevron rings 42*a*, concave downwardly so as to be self-energizing by virtue of pressure from below, three lower chevron rings 42*b* facing in the opposite direction so as to be self-energizing by virtue of pressure acting in the opposite direction, and an O-ring 42*c* disposed between the upper 42*a* and lower 42*b* chevron rings, O-ring 42*c* serving as a spacer. In a similar manner, tubular member 10 has a second counterbore 44 that cooperates with a reduced diameter portion 46 on lower tubular member 14 to form a second annular seal recess, second seal recess containing a seal stack 46, essentially the same as seal stack 42. Seal stacks 42 and 46 effectively form auxiliary upper and lower seal assemblies, respectively.

Central tubular member 10 is also provided with an annular recess 62, recess 62 being positioned between lower auxiliary seal stack 46 and flow ports 36. Disposed in annular recess 62 is an annular seal ring, shown generally as 64 and described more fully hereinafter.

Figure 1C:
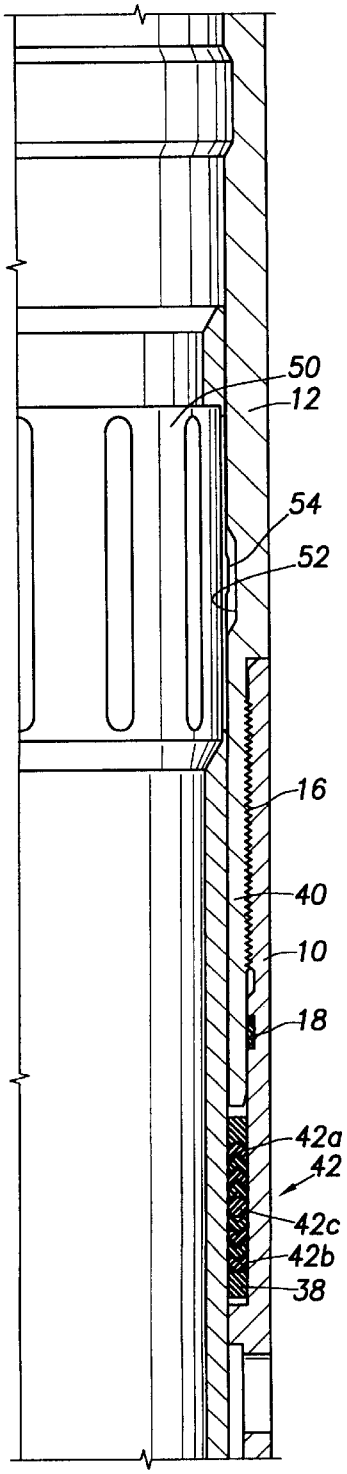
Figure 1D:
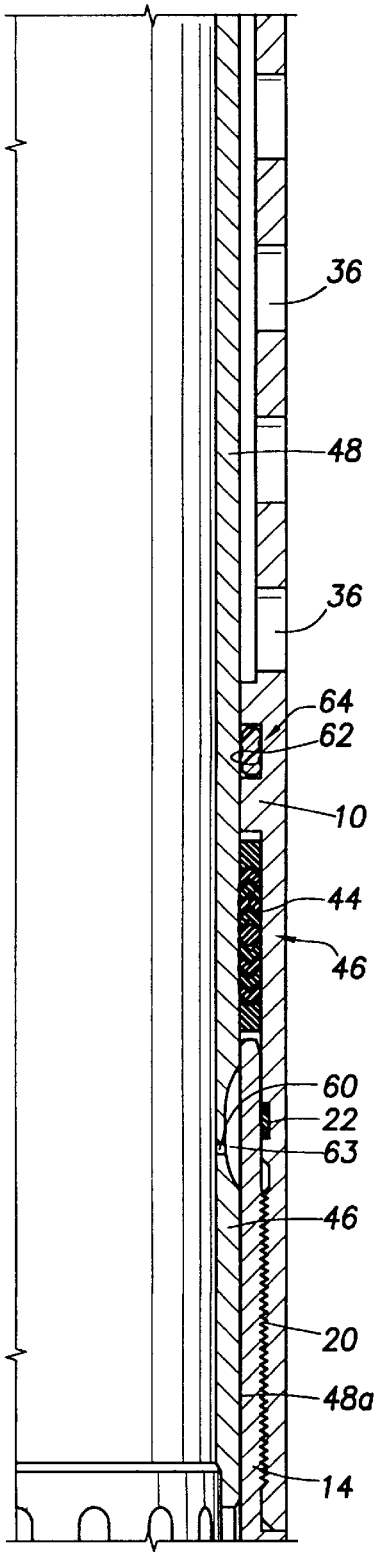
Figure 1E:
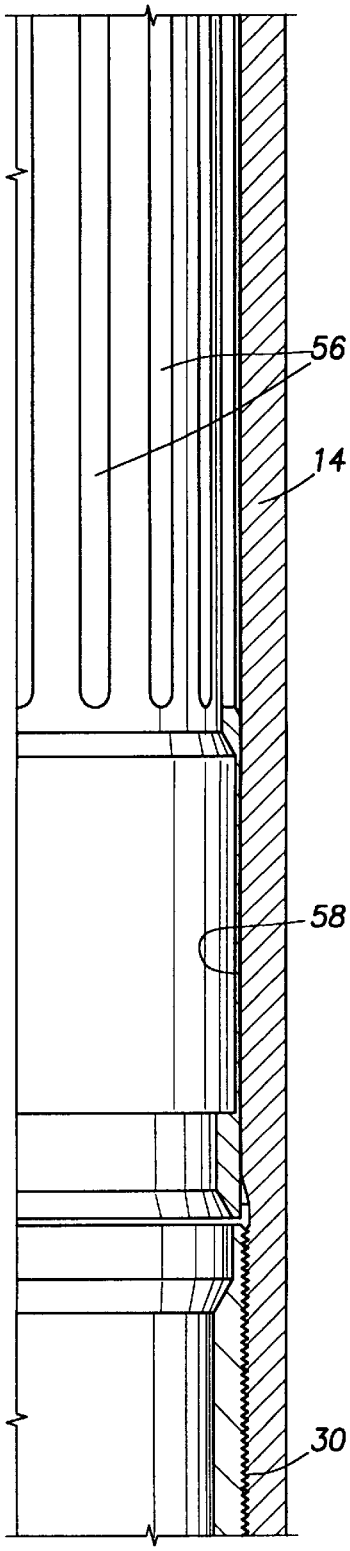
Figure 1F:
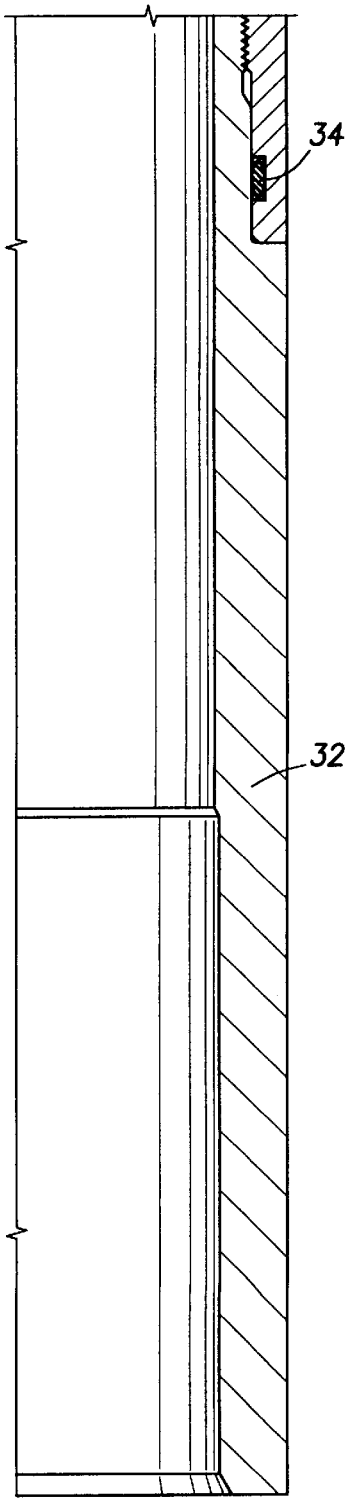

Slidably, coaxially disposed in the housing comprised of central tubular section 10 and upper and lower tubular sections 12 and 14 is a sliding sleeve 48. At its upper end, sleeve 48 includes a flexible collet, shown generally as 50, on the tines of which are formed a series of radially aligned, outwardly facing projections or dogs 52, which, when the valve is in the closed position and as shown in FIG. 1*c*, are received in an internal annular groove 54 in upper tubular member 12. It can thus be seen that when projections 50 are received in groove 54, sleeve 48 is effectively latched in the position shown in FIGS. 1*a*–1*f*, i.e., the closed position. Extending downwardly from collet structure 50, sliding sleeve 48 is of essentially uniform outside diameter and sized to slide along the inner diameter of upper and lower tubular members 12 and 14, respectively, it being understood that there is sufficient clearance between sleeve 48 and the inside diameter of tubular members 12 and 14 to permit such sliding movement.

Near its lower end, sleeve 48 has a counterbore through which are formed at least one, but preferable a series of, circumferentially spaced, longitudinally elongated, full flow radial slots or apertures 56 for a purpose to be described hereinafter. Below slots 56, sleeve 48 has an annular recess 58, which can be engaged by a suitable shifting tool for moving sleeve 48 in a manner well known to those skilled in the art.

Between collet structure 50 and full flow slots 56, sleeve 48 has a tubular seal portion 48*a* or section that is generally of uniform inner and outer diameter, broken only by at least one pressure relief orifice 60 and a recess 62 in the outer surface of sleeve 48, the recess 62 surrounding and adjoining the radially outer end of orifice 60. It will be appreciated that any desired number of pressure relief orifices and recesses may be circumferentially spaced around sleeve 48.

Figure 2A:
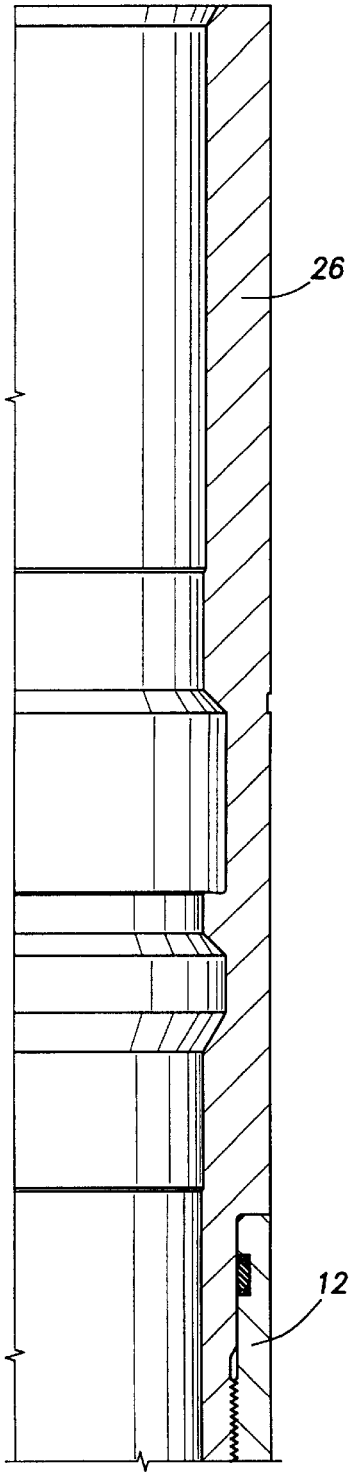
FIGS. 2*a*–2*f* are views similar to FIGS. 1*a*–1*f* showing the valve in a pressure-equalizing position.
Figure 2B:
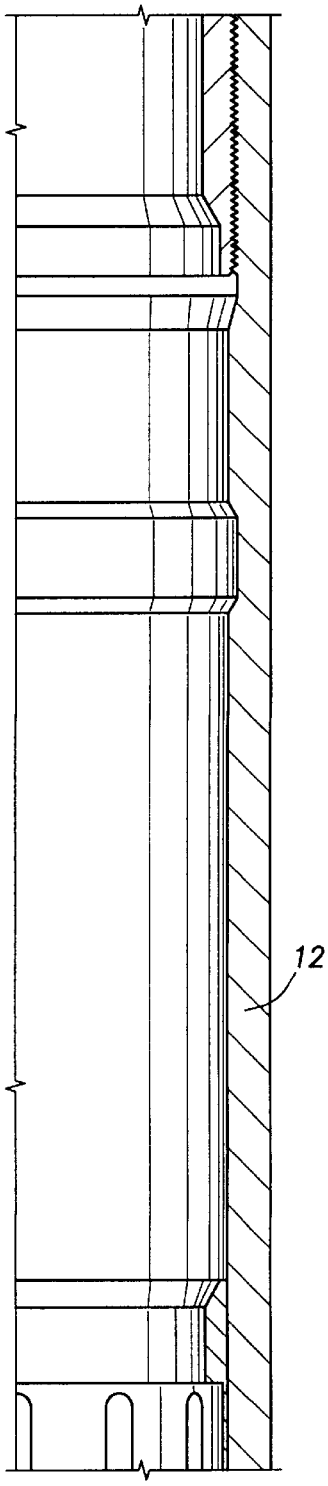
Figure 2C:
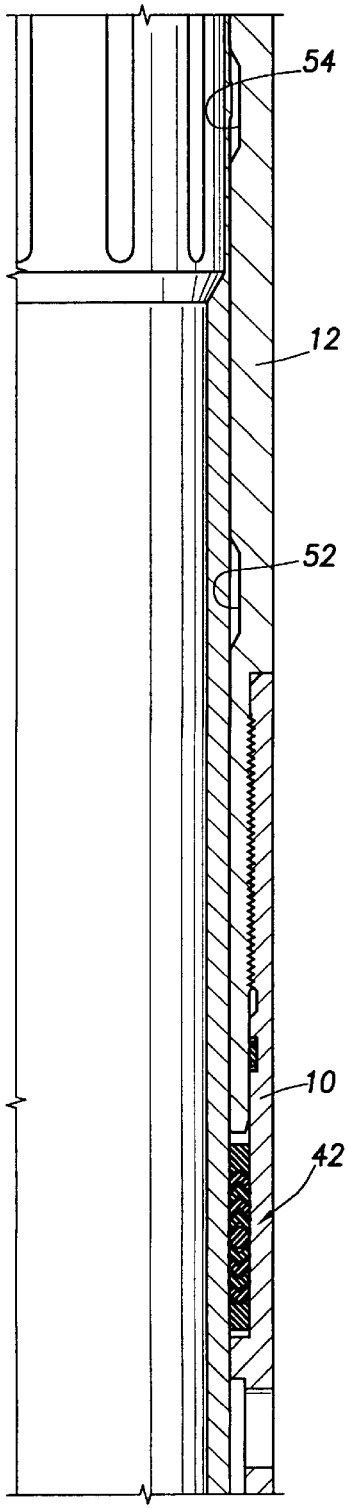
Figure 2D:
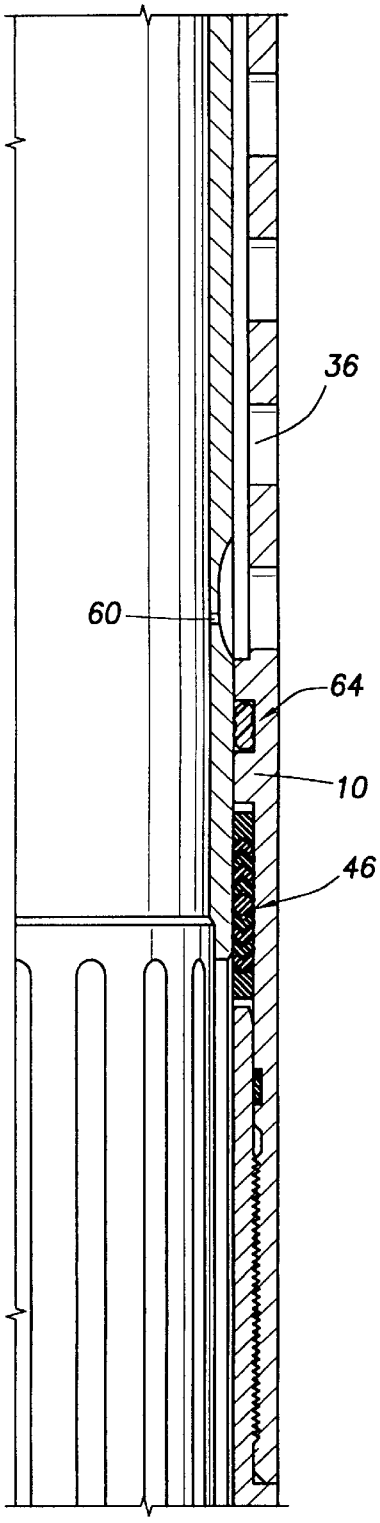
Figure 2E:
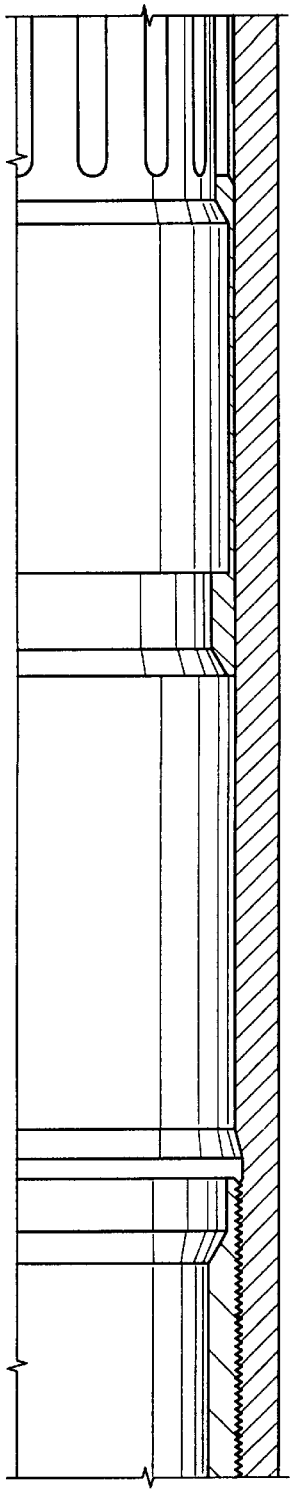
Figure 2F:
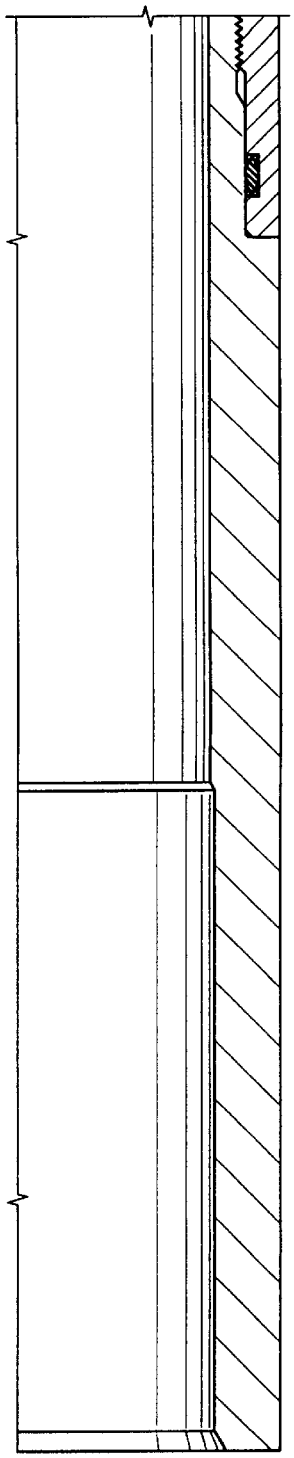

With reference now to FIGS. 2*a*–2*f*, the sleeve valve of the present invention is shown as being moved to an equalizing position. To accomplish this, a suitable operating tool, i.e., a shifting tool, is engaged, in the well-known manner, in recess 58. By a jarring upward pull, the shifting tool forms the dogs 52 to disengage from groove 54, whereupon sleeve 48 can now be moved upwardly from the position shown in FIGS. 1*a*–1*f* to the position shown in FIGS. 2*a*–2*f*. It will be seen that in the position shown in FIGS. 2*a*–2*f*, the dogs 52 and collet 50 have been moved upwardly until the dogs 52 snap into annular groove 54, formed in upper tubular member 12. With particular reference to FIG. 2*d*, it will now be seen that relief orifice(s) 60 is now in open communication with flow ports 36, permitting pressure in the annulus exterior of central tubular member 10 to bleed off or equalize until the pressure in the annulus and in the tubing string is substantially the same.

Figure 3A:
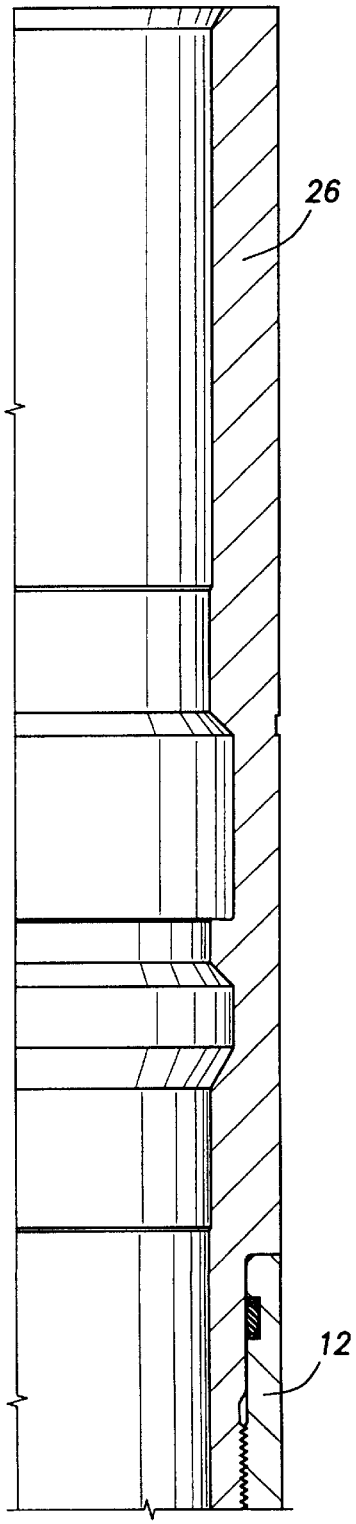
FIGS. 3*a*–3*f* are view similar to FIGS. 1*a*–1*f* with the valve in the full open position.
Figure 3B:
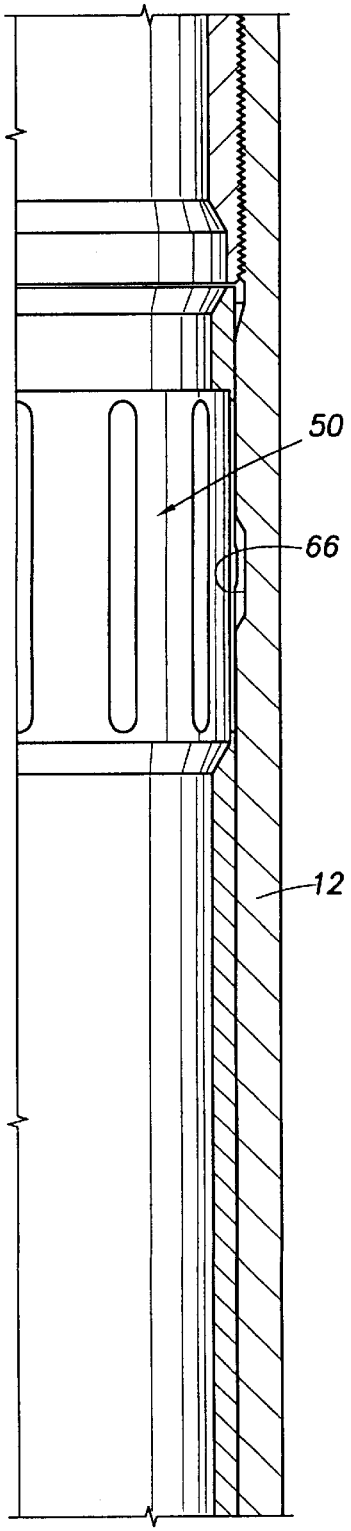
Figure 3C:
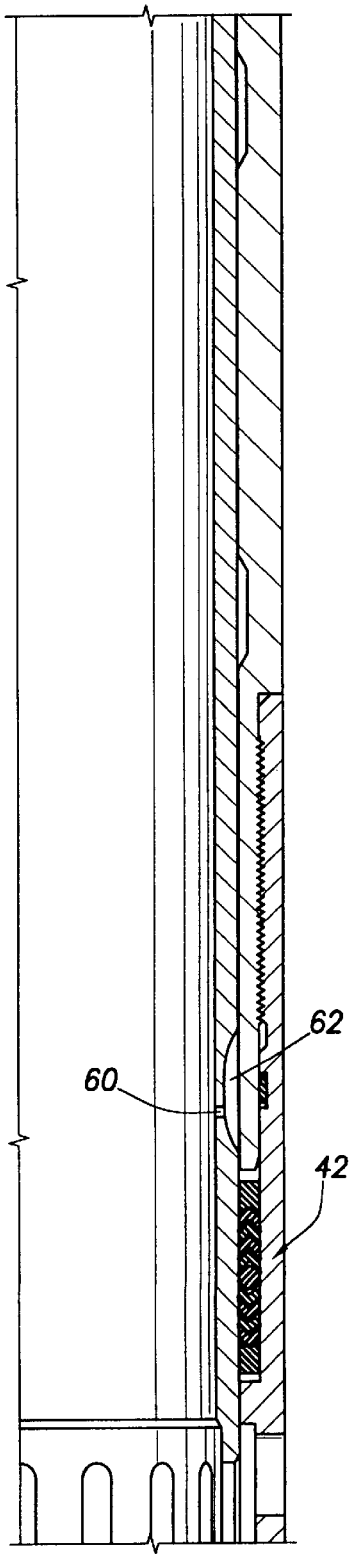
Figure 3D:
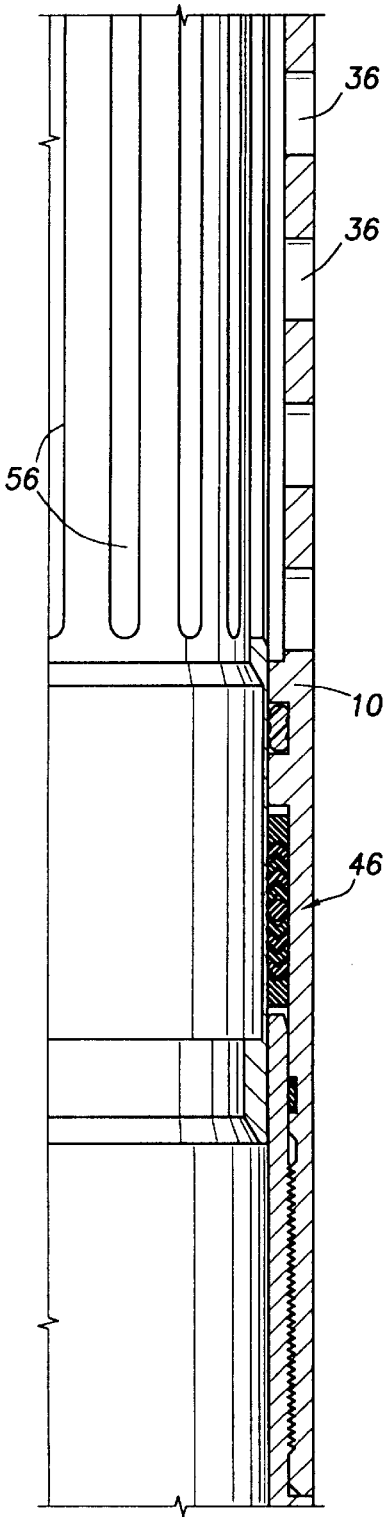
Figure 3E:
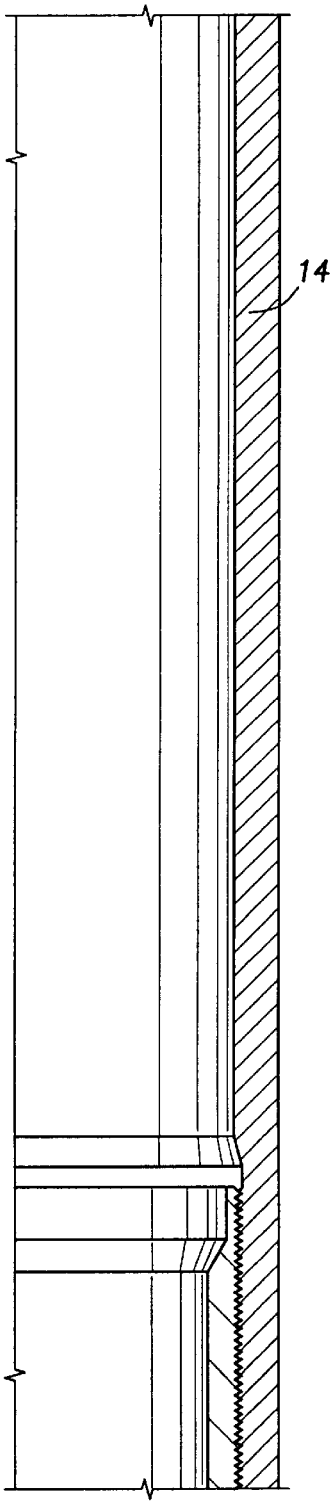
Figure 3F:
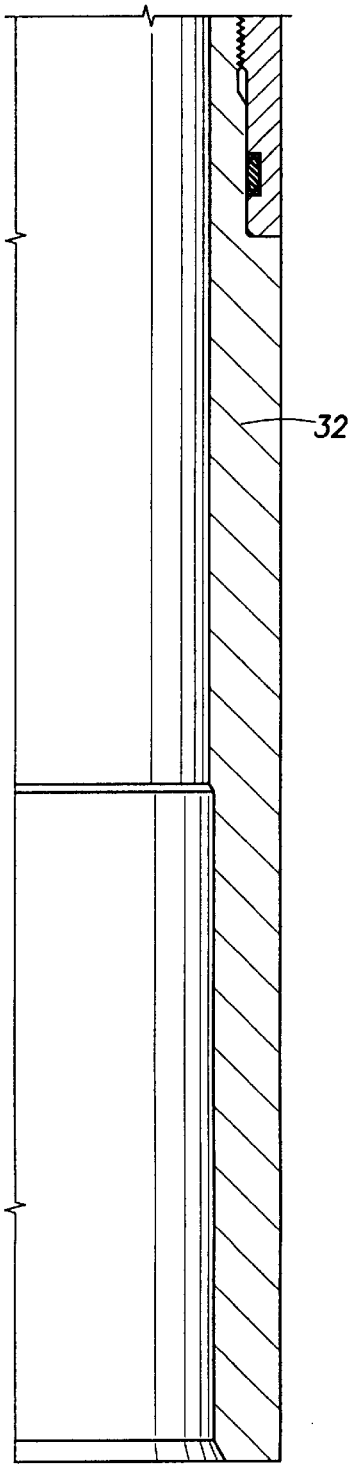

If it is now desired to fully open the sleeve valve, the sleeve 48 is again shifted upwardly in the manner described above such that now dogs 52 engage annular recess 66 in upper tubular member 12. As best seen with reference to FIG. 3*d*, this places flow slots or apertures 56 in register with flow ports 36, thus allowing a much greater flow area between the annulus exterior of central tubular member 10 and the interior of the tubing string.

As noted in the position shown in FIGS. 1*a*–1*f*, the sleeve valve is in a closed position; i.e., fluid from the annulus is prohibited from flowing into the interior of the sleeve valve and hence the tubing string by virtue of the upper and lower chevron seal stacks 42 and 46 and primary seal member 64. Nonetheless, it will be appreciated that annulus pressure acts upon primary seal member 64. Depending upon this pressure, in the past it has been found that if primary seal member 64 is an O-ring, and the pressure sufficiently high enough, the O-ring will extrude into the clearance between the sleeve 48 and central tubular member 10. To alleviate this problem, and as disclosed in the '683 patent, anti-extrusion, or backup, rings are provided together with the O-ring, such backup rings being of a substantially non-elastic material but having greater compressibility than metal so as to be compressed slightly between the sleeve and the central tubular member. Coupled with the provision of recess 62, that expedient serves, to a large degree, to prevent clipping of the O-ring, as described above. However, such a primary seal assembly, having multiple parts, is more time-consuming to assemble. On the other hand, failure to provide the backup, or anti-extrusion, rings often resulted in premature failure of the O-ring, depending upon the annulus pressure, due to the clipping action described above. As described hereinafter, the primary seal member of the present invention overcomes the problem of having to use a primary seal member comprised of multiple parts.

Figure 4:
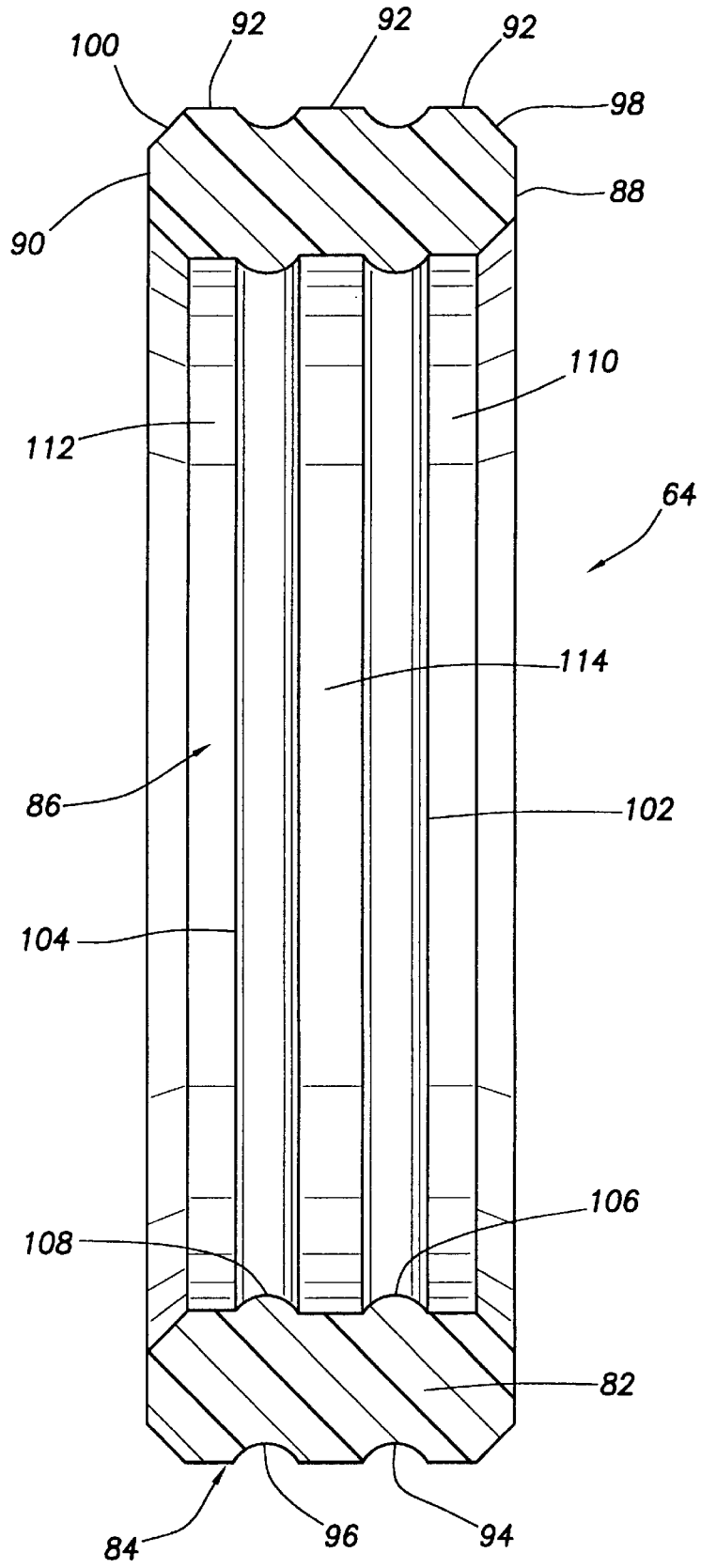
FIG. 4 is an elevational view, partly in section, showing one embodiment of the primary seal member according to the present invention.

With reference now to FIG. 4, there is shown a preferred embodiment of the primary seal member or ring used in the sleeve valve of the present invention. The seal member, which is shown generally as 64 and in the relaxed condition, has an annular, monolithic body 82, i.e., it is not scarf-cut or, in any other way, a split ring. Seal member 64 has a first radially outwardly facing, annularly extending seal surface, shown generally as 84, and a second, radially inwardly facing, annularly extending seal surface, shown generally as 86. Body 82 further comprises a first annularly extending, axially facing end face 88 and a second annularly extending, axially facing end face 90. As shown, faces 88 and 90 are substantially parallel to one another, faces 88 and 90 defining an axial length therebetween. It can be seen, for example, with reference to FIG. 1*d*, that the axial length of the body 82 of seal member 64 is substantially the same as the axial width of the groove 62 in which it is received, allowance being made for thermal expansion such that the axial width of groove 62 is slightly greater than that of the axial length of seal member 64 between faces 88 and 90. First, radially outwardly facing seal face 84 defines a cylindrical sealing face 92, which is interrupted by annularly extending first and second annularly recesses 94 and 96, respectively. Additionally, and in the embodiment shown in FIG. 4, an annular chamfer 98 connects first axial face 88 and first seal surface 92, and a second annular chamfer 100 connects first seal surface 92 and second axial face 90.

Second, radially inwardly facing seal surface 86 is provided with first and second annularly extending, radially inwardly projecting ribs 102 and 104. As seen, ribs 102 and 104 have convex portions 106 and 108, respectively when viewed in transverse cross-section. In other words, the radially innermost portion of seal face 86 is formed by convexed or radiused ribs 106 and 108, which are axially spaced from one another. It will be understood, as seen with FIG. 1*d*, that the convex portions 106 and 108 contact the seal portion 48*a* of sleeve 48 when seal 64 is received between sleeve 48 and housing 10. Likewise, it will be appreciated that seal surface 92 is in sealing engagement with central tubular member 10, whereby a substantially fluid-tight sealing engagement is accomplished between seal member 64 and sleeve 48, and seal member 64 and tubular member 10.

As can be seen from FIG. 4, first annular recess 94 is spaced from first end face 88 by substantially the same distance that first rib 102 is spaced from first end face 88. Likewise, second annular recess 96 is spaced from second end face 90 by substantially the same distance that second rib 104 is spaced from second end face 90.

The second seal surface 86 of seal member 64 is further characterized in that there is an annularly extending relief formed on each axial side of each of ribs 102 and 104. Thus, a first relief 110 is formed on the axially outward side of rib 102, and a second relief 112 is formed on the axially outward side of rib 104. A central, annularly extending relief 114 is formed between ribs 102 and 104. As seen, reliefs 110, 112, and 114 essentially form cylindrical surfaces spaced radially outwardly from convex portions 106 and 108, ribs 102, 104, and relief 114 serving to define an annular channel or recess. Seal member 64 is also constructed such that the radial thickness as measured, for example, from any of reliefs 110, 112, or 114 to seal surface 92 is substantially the same as the groove 62 into which seal member 64 is received. While seal member 64 is shown as having two annular ribs 102, 104, it is to be understood that a seal member having a single annular rib that forms a radially innermost convex or radiused surface for engaging the sleeve 48 would also be effective.

It has been found in tests that a seal member in the configuration shown in FIG. 4 and made of a carbon/ graphite/TFE blend marketed as GSF 7130 by GSF Plastics Corp. has been able to undergo equalization of differential pressures of 5,000 psi, cycled 25 times at 350° F. with no loss of sealing between housing and sleeve. Surprisingly, this equalization of differential pressure was accomplished by moving the valve from the closed to the fully open position, i.e., without allowing the pressure to be bled down through the bleed orifices. Thus, the sleeve valve of the present invention can be made without the optional bleed orifices, albeit that in many cases, it would be desirable to have such bleed orifices, particularly if unexpectedly high pressures were encountered.

While all the reasons for the unexpected sealing capabilities of the primary seal member of the present invention are not fully understood, it is believed that such sealing capabilities are a function of the configuration and the material(s) of construction of the seal member. With respect first to the configuration, it is believed that the convex or radiused surface on the rib or ribs used to sealingly engage the sliding sleeve results in a reduced contact area between the rib and the sleeve, even when the seal is in the sleeve valve, sealingly engaging the sleeve and the housing. Additionally, this radiused or convex configuration of the ribs exposes no abrupt edges to the sleeve as it is moving, meaning that there is less likelihood of any chipping of the ring occurring. It may also be that the relief on the upstream side of the seal member acts as a pressure-responsive surface to offset, to some extent, the fluid pressure that acts against the first seal surface to urge the seal member radially inward against the sleeve; i.e., the seal member is under more balanced pressure loading on the opposed first and second surfaces. Also, since the radial thickness of the seal member measured from the relief on the downstream side of the seal member 64 to the first seal surface 92 is substantially the same as the depth of the groove 62, there is little likelihood of any material extruding into the space between a sleeve and the tubular member 10.

With respect to the materials of construction of the seal member, it will be made of a material that is substantially non-elastomeric but nonetheless possesses sufficient memory to provide an interference seal between the seal member and the housing and the seal member and the sleeve. Typically, the material from which the seal is made will have a hardness (shore D) of from about 50 to about 70, and it is preferred that the material of construction include a lubricant to facilitate lowering friction between the sleeve and the seal. A particular feature of the material from which the primary seal member is made is that it must possess sufficient flexibility to permit the seal member to have a circumferential portion temporarily deformed radially inward so as to reduce its outer peripheral dimension, the material still possessing sufficient memory such that when a force acting to temporarily deform the seal member is released, the seal member can be returned to its original configuration, i.e., it can be "popped" back into a circular configuration. This characteristic of the material and the seal is absolutely essential for the seal to be installed as a monolithic member in the female seal ring groove. Indeed, absent this characteristic, it would be necessary to form the seal ring as a split ring or the like, meaning that there would inherently be leakage at the point where the ring was split or scarf-cut. The seal ring must also be made of a material that resists extrusion under elevated temperatures and/or pressures, e.g., temperatures ranging from about 100° F. to 350° F. and pressures ranging from 1500 to 8000 psi, to prevent the seal material from being forced into the relatively tight spacing between the sleeve and the housing. Once again, and as noted above, this increases the chances of chipping of the seal, eventually ruining its effectiveness to seal off fluid pressure. As noted above, a seal member comprised of a carbon/graphite/polytetrafluoroethylene blend has been found to be particularly useful as a material to form the seal used in the sleeve valve of the present invention. It will be appreciated that the seal can be made of other materials, such as, for example, moly/polytetrafluoroethylene blends, fiberglass/polytetrafluoroethylene blends, etc., provided that the seal member possesses enough elasticity or flexibility that, as a monolithic member, it can installed in a female groove and also provide an interference seal with the sleeve and the groove (housing) such that it seals at temperatures ranging from about 30° F. to about 350° F.

Other properties that the material from which the primary seal member is made include a tensile strength (psi) at 73° F. of between about 2000 and 2600 as measured by ASTM D638 and an elongation (%) at 73° F. of from about 30 to about 70 as measured by ASTM D638.

The foregoing description and examples illustrate selected embodiments of the present invention. In light thereof, variations and modifications will be suggested to one skilled in the art, all of which are in the spirit and purview of this invention.

What is claimed is:

1. In a sliding sleeve valve for controlling fluid flow between a well annulus and a string of well conduit, said valve including a tubular housing adapted for connection into said string and having at least one radial flow port therethrough, a sleeve disposed co-axially within said housing for selective, longitudinal movement relative to said housing, said sleeve having an annular outer seal portion and at least one radial flow aperture, a primary annular seal member carried by said housing, disposed between and sealingly engaging said housing and said seal portion of said sleeve and spaced longitudinally from said flow port in a first direction, said valve having a closed position wherein said sleeve is positioned such that said flow aperture is axially spaced from said primary seal member in said first direction and an open position wherein said flow aperture is longitudinally spaced from said primary seal member in a second direction opposite the first direction and in communication with said flow port, the improvement characterized in that said primary seal member, in a relaxed condition, comprises an annular, monolithic body having a first, radially outwardly facing, annularly extending, seal surface and a second, radially inwardly facing, annular extending seal surface, said second seal surface comprising first and second, axially spaced, annularly extending, radially inwardly projecting ribs, each of said ribs having a radially innermost convex portion when viewed in transverse cross-section, an annularly extending relief being formed being formed between said first and second ribs, said first seal surface sealingly engaging said housing and said convex portion sealingly engaging with said seal portion of said sleeve when said primary seal member is disposed between said housing and said sleeve, said seal member being made of a substantially non-elastomeric material but having sufficient memory to provide an interference seal between said seal member and said housing, and said seal member and said sleeve.

2. The sleeve valve of claim 1 wherein said primary seal is received in a groove in said housing, said groove having an axial length, said primary seal member having an axial length substantially the same as the axial length of said groove.

3. The sleeve valve of claim 1 wherein said first seal surface has at least one annularly extending recess formed therein.

4. The sleeve valve of claim 1 wherein said primary seal member has a first axial face and a second axial face, the distance between said first axial face and said second axial face being greater than the greatest radial thickness of said primary seal member.

5. The sleeve valve of claim 1 wherein said primary seal member is comprised of a carbon/graphite/polytetrafluoroethylene blend.

6. The sleeve valve of claim 1 wherein said primary seal member is formed of a material resistant to extrusion at elevated pressure and temperature extrusion.

7. The sleeve valve of claim 1 wherein said first seal surface comprises first and second, annularly extending, axially spaced recesses.

8. The sleeve valve of claim 7 wherein said first rib and said first recess are spaced from said first axial side by substantially the same distance and said second rib and said second recess are spaced from said second axial side by substantially the same distance.

9. The sleeve valve of claim 1 wherein said sleeve includes at least one radial bleed orifice in said seal portion, said valve having a pressure relief position wherein said sleeve is positioned such that said bleed orifice is in communication with said flow port and said bleed orifice is longitudinally spaced from said primary seal in a second direction.

10. In a sliding sleeve valve for controlling fluid flow between a well annulus and a string of well conduit, said valve including a tubular housing adapted for connection into said string and having at least one radial flow port therethrough, a sleeve disposed co-axially within said housing for selective, longitudinal movement relative to said housing, said sleeve having an annular outer seal portion and at least one radial flow aperture, a primary annular seal member carried by said housing, disposed between and sealingly engaging said housing and said seal portion of said sleeve and spaced longitudinally from said flow port in a first direction, said valve having a closed position wherein said sleeve is positioned such that said flow aperture is axially spaced from said primary seal member in said first direction and an open position wherein said flow aperture is longitudinally spaced from said primary seal member in a second direction opposite the first direction and in communication with said flow port, the improvement characterized in that said primary seal member, in a relaxed condition, comprises an annular, monolithic body having a first, radially outwardly facing, annularly extending, seal surface and a second, radially inwardly facing, annular extending seal surface, said second seal surface comprising at least one annularly extending, radially inwardly projecting rib, said rib having a radially innermost convex portion when viewed in transverse cross-section, a first annularly extending relief being formed on a first axial side of said rib, a second annularly extending relief being formed on a second axial side of said rib, said first seal surface sealingly engaging said housing and said convex portion sealingly engaging with said seal portion of said sleeve when said primary seal member is disposed between said housing and said sleeve, said seal member being made of a substantially non-elastomeric material but having sufficient memory to provide an interference seal between said seal member and said housing, and said seal member and said sleeve, said seal member being made of a material having a hardness (Shore-D) of from about 50 to about 70.

11. In a sliding sleeve valve for controlling fluid flow between a well annulus and a string of well conduit, said valve including a tubular housing adapted for connection into said string and having at least one radial flow port therethrough, a sleeve disposed co-axially within said housing for selective, longitudinal movement relative to said housing, said sleeve having an annular outer seal portion and at least one radial flow aperture, a primary annular seal member carried by said housing, disposed between and sealingly engaging said housing and said seal portion of said sleeve and spaced longitudinally from said flow port in a first direction, said valve having a closed position wherein said sleeve is positioned such that said flow aperture is axially spaced from said primary seal member in said first direction and an open position wherein said flow aperture is longitudinally spaced from said primary seal member in a second direction opposite the first direction and in communication with said flow port, the improvement characterized in that said primary seal member, in a relaxed condition, comprises an annular, monolithic body having a first, radially outwardly facing, annularly extending, seal surface and a second, radially inwardly facing, annular extending seal surface, said second seal surface comprising at least one annularly extending, radially inwardly projecting rib, said rib having a radially innermost convex portion when viewed in transverse cross-section, a first annularly extending relief being formed on a first axial side of said rib, a second annularly extending relief being formed on a second axial side of said rib, said first seal surface sealingly engaging said housing and said convex portion sealingly engaging with said seal portion of said sleeve when said primary seal member is disposed between said housing and said sleeve, said seal member being made of a substantially non-elastomeric material but having sufficient memory to provide an interference seal between said seal member and said housing, and said seal member and said sleeve, said seal member comprising a material containing a lubricant.

12. In a sliding sleeve valve for controlling fluid flow between a well annulus and a string of well conduit, said valve including a tubular housing adapted for connection into said string and having at least one radial flow port therethrough, a sleeve disposed co-axially within said housing for selective, longitudinal movement relative to said housing, said sleeve having an annular outer seal portion and at least one radial flow aperture, a primary annular seal member carried by said housing, disposed between and sealingly engaging said housing and said seal portion of said sleeve and spaced longitudinally from said flow port in a first direction, said valve having a closed position wherein said sleeve is positioned such that said flow aperture is axially spaced from said primary seal member in said first direction and an open position wherein said flow aperture is longitudinally spaced from said primary seal member in a second direction opposite the first direction and in communication with said flow port, the improvement characterized in that said primary seal member, in a relaxed condition, comprises an annular, monolithic body having a first, radially outwardly facing, annularly extending, seal surface and a second, radially inwardly facing, annular extending seal surface, said second seal surface comprising at least one annularly extending, radially inwardly projecting rib, said rib having a radially innermost convex portion when viewed in transverse cross-section, a first annularly extending relief being formed on a first axial side of said rib, a second annularly extending relief being formed on a second axial side of said rib, said first seal surface sealingly engaging said housing and said convex portion sealingly engaging with said seal portion of said sleeve when said primary seal member is disposed between said housing and said sleeve, said seal member being made of a substantially non-elastomeric material but having sufficient memory to provide an interference seal between said seal member and said housing, and said seal member and said sleeve, said primary seal member being formed of a material having sufficient flexibility to permit said seal member to have a circumferential portion thereof temporarily deformed radially inward so as to reduce the outer peripheral dimension of said primary seal member but which possesses sufficient memory such that said primary seal member can be returned to its original configuration when the force acting to temporarily deform said seal member is released.

* * * * *

UNITED STATES PATENT AND TRADEMARK OFFICE

CERTIFICATE OF CORRECTION

PATENT NO. : 6,044,908

DATED : April 4, 2000

INVENTOR(S) : Mark L. Wyatt

It is certified that error appears in the above-identified patent and that said Letters Patent is hereby corrected as shown below:

In column 9, line 28, delete "a" and insert therefor --said--.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*